US005379825A

United States Patent [19]

Jelic

[11] Patent Number: 5,379,825

[45] Date of Patent: Jan. 10, 1995

[54] WINDOW BLIND BETWEEN TWO PANES OF GLASS

[75] Inventor: Ralph Jelic, Valencia, Pa.

[73] Assignee: Verosol USA Inc., Pittsburgh, Pa.

[21] Appl. No.: 112,438

[22] Filed: Aug. 26, 1993

[51] Int. Cl.[6] ..... E06B 3/32

[52] U.S. Cl. ..... 160/107; 160/168.1 R

[58] Field of Search ..... 160/107, 104, 168.1 R, 160/176.1 R, 177 R, 173 R, 172 R

[56] References Cited

U.S. PATENT DOCUMENTS

| | | | |
|---|---|---|---|
| 3,719,221 | 3/1973 | Hanson | 160/107 X |
| 3,795,267 | 3/1974 | Debs | 160/107 X |
| 4,274,469 | 6/1981 | Kuyper et al. | 160/107 |
| 4,664,169 | 5/1987 | Osaka | 160/107 |
| 4,687,040 | 8/1987 | Ball | 160/107 |
| 4,913,213 | 4/1990 | Schnelker | 160/107 |
| 5,184,660 | 2/1993 | Jelic | 160/171 |

*Primary Examiner*—David M. Purol

*Attorney, Agent, or Firm*—Buchanan Ingersoll; Lynn J. Alstadt

[57] ABSTRACT

A window blind for use between double panes of glass which has an aperture in one pane of glass. The blind can be raised, lowered and tilted while maintaining the window seal. The blind includes a headrail, slats, a hollow screw with longitudinal screw channels. The hollow screw passes a headrail aperture and a glass aperture from inside the headrail to outside thus being threaded into a screw duct. At least one lift cord and a tilt control cord separately pass through the longitudinal screw channels thereby providing an external way to control the window blind.

18 Claims, 8 Drawing Sheets

WINDOW BLIND BETWEEN TWO PANES OF GLASS

BACKGROUND OF THE INVENTION

1. Field of the Invention

The present invention relates to a window blind for use between double panes of glass.

2. Description of the Prior Art

It is well known in the art that double panes of glass in a window provides better insulation than a single pane of glass. It is also known in the art to provide venetian type blinds or pleated shades between two panes of glass. A pleated blind between window panes is disclosed in the U.S. Pat. No. 4,913,213 to Schnelker. A venetian or slat blind between panes of glass is disclosed in the U.S. Pat. No. 4,687,040 and 4,664,169. Control means for lifting, lowering and tilting the blind from one side of the window must be provided while maintaining the window seal.

The U.S. Pat. No. 4,664,169 to Osaka et al. discloses a device for tilting slats of a venetial blind between double panes of glass. The device uses electrical power driving means to move piezoelectric bimorph device in a horizontal plane. The piezoelectric bimorph device is mounted to a block having a threaded bore. The block is secured to a screw which is threaded to a nut after passing through one pane of glass. The piezoelectric bimorph device mechanically moves an elongated V-shaped beam under two cross arms which control the rotation of the slats. When the beam is moved, the cross arms are tilted, thereby rotating the slats.

The U.S. Pat. No. 4,687,040 to Ball discloses a device for adjusting the tilt angle of slats of a slat blind positioned between the panes of glass. The device includes a hole in one pane of glass and a flexible cable passing through the hole. The cable is connected to a rectangular member which controls the rotation of the slats. When the cable is turned by external torque, the slats are tilted.

The U.S. Pat. No. 4,913,213 discloses a pleated blind between double window panes and blind control means for raising and lowering the blind. One embodiment is comprised of an aperture in one pane of glass and a bolt with a center hole mounted in the aperture. An actuator cord passes through the bolt hole and further up and over a screen, if desired, thereby providing an external control mechanism. Another embodiment provides routing the actuator cord over the glass housing and any screen housing provided. One of the problems with this blind is that sharp edges of the bolt cuts the actuator cord thereby shortening the life of the blind.

All of these control systems either have complicated mechanisms or require a headrail which is too wide to fit between the panes of those windows whose panes are not more than $\frac{3}{4}$ inches apart. Thus, the prior art blinds are either not suitable for currently popular double or triple windows, or difficult to make, install and maintain.

SUMMARY OF THE INVENTION

This invention relates to a window blind to be positioned between two panes of glass and to be raised, lowered and tilted while maintaining the window seal. The blind is comprised of spaced parallel slats which are secured to a headrail by at least one tilt cord. The headrail is mounted adjacent one pane of glass. A hollow screw passes from inside the headrail through an aperture in the headrail and an aperture in the pane of glass. A screw duct is threaded onto the screw. The screw and screw duct in this invention is free of sharp edges.

The screw has two separate longitudinal channels. At least one lift cord passes through a first channel and at least one tilt control cord passes through a second channel. These cords provide an external control means to raise, lower and tilt the blind while maintaining the window seal.

The slats are lifted by at least one lift cord which is extended from the headrail to a bottom rail. The slats are tilted by tilt control means.

The tilt control means are comprised of a tilt rod, a tilt spool, at least one support and tape roll, a tilt control cord, and at least one tilt cord. The tilt rod is positioned parallel to the slats within the headrail by at least one support and tape roll. At least one tilt cord is connected to the slats and also to the tape roll. The tilt spool is attached to the tilt rod and positioned adjacent the headrail aperture right behind the screw, sitting in a line with the screw. The tilt control cord is wound around the tilt spool and then both ends pass through the second screw channel. When one of the ends of the tilt control cord is manually pulled, the tilt spool is rotated clockwise or counterclockwise, and the tilt rod is indirectly moved in the same direction thereby tilting the slats.

Other details, objects and advantages of the invention will become apparent as the following description of certain present preferred embodiments thereof proceeds. In the accompanying drawings I have shown certain present preferred embodiments of the invention.

DETAILED DESCRIPTION OF THE INVENTION

Figure 1:
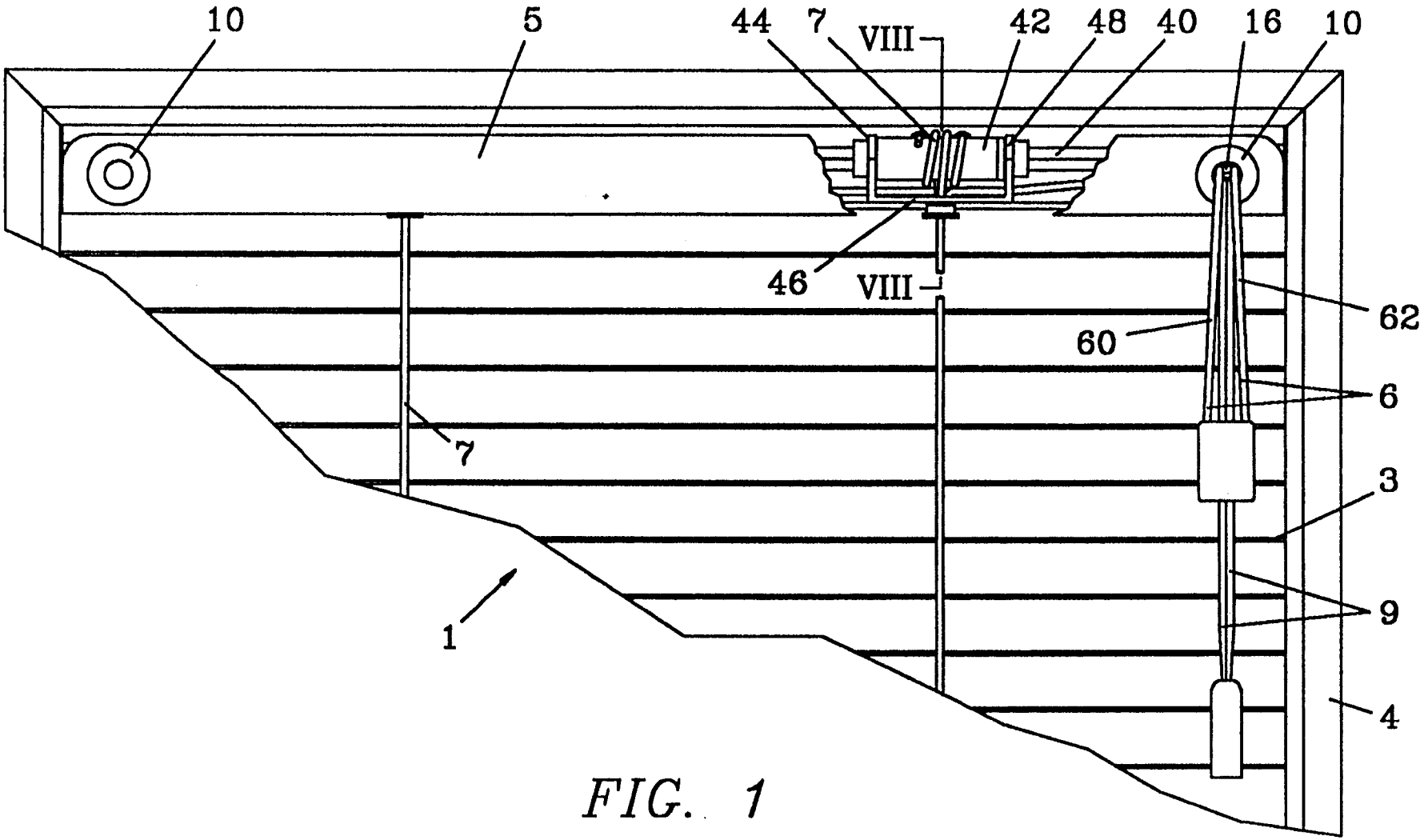
FIG. 1 is an elevational front view of a portion of a present preferred window blind mounted in a window.
Figure 2:
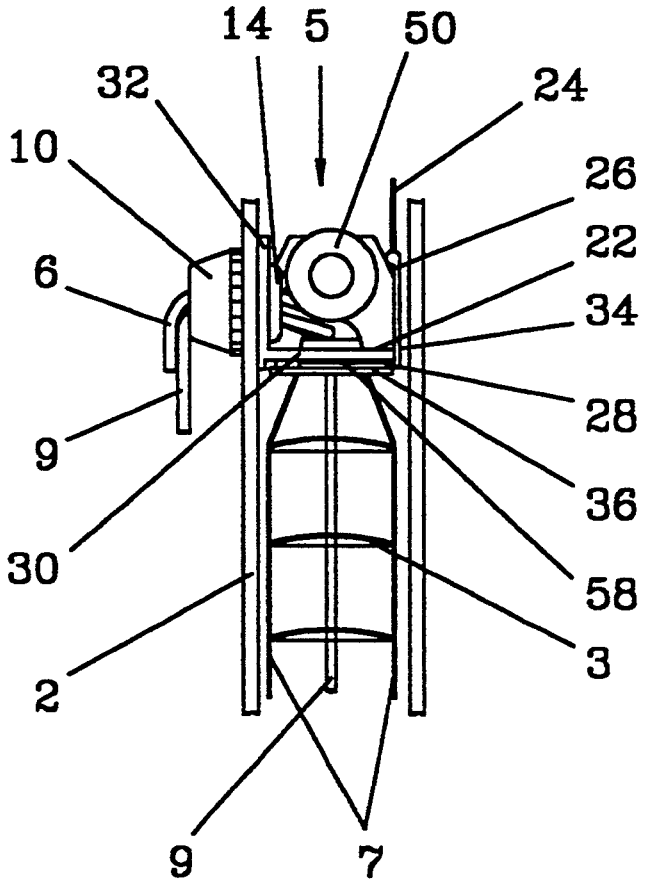
FIG. 2 is a side view of the window blind of FIG. 1.

As shown in FIGS. 1 and 2, a window blind 1 is positioned between two panes of glass seated in a window frame 4. The blind has a plurality of spaced parallel slats 3 which are typically made of aluminum.

At least one tilt cord 7 which extends from a tiltrod 40 within a headrail 5 is secured to and supports the slats 3. I prefer to use a ladder-braid type tilt cord as shown in FIG. 2. The slats 3 are rotated about parallel axes by a tilt control cord 6. The tilt control cord 6 is wound around a tilt spool 50 within the headrail 5, and both ends 60, 62 pass through a hollow screw 14 which passes through the headrail 5 and a pane of glass 2. A screw duct 10 is threaded onto the screw 14.

When one of the ends 60, 62 of the tilt control cord 6 is manually pulled, the tilt spool 50 is rotated clockwise or counterclockwise. The tiltrod 40 is then moved in the same direction thereby moving the tilt cord 7. Thus, the slats 3 are tilted.

At least one lift cord 9 extends from the headrail 5 through the slats 3 to a bottom rail (not shown). The slats 3 are lifted and lowered by the lift cord 9. The lift cord 9 runs through the headrail 5 and passes the hollow screw 14. When the lift cord 9 is pulled or released, the slats 3 are lifted or lowered. Thus, the blind 1 is tilted, lifted or lowered by external manipulation of the tilt control cord 6 or the lift cord 9 while maintaining the window seal.

Figure 3:
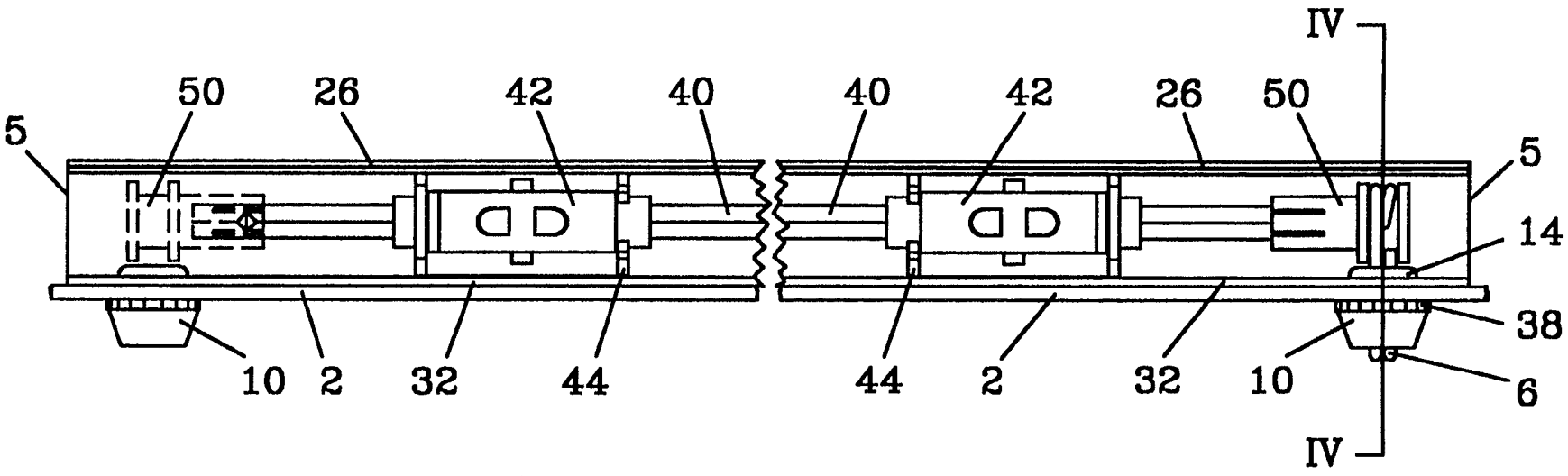
FIG. 3 is a top plan view of a present preferred headrail wherein a lift cord and a tilt cord are not shown.
Figure 4:
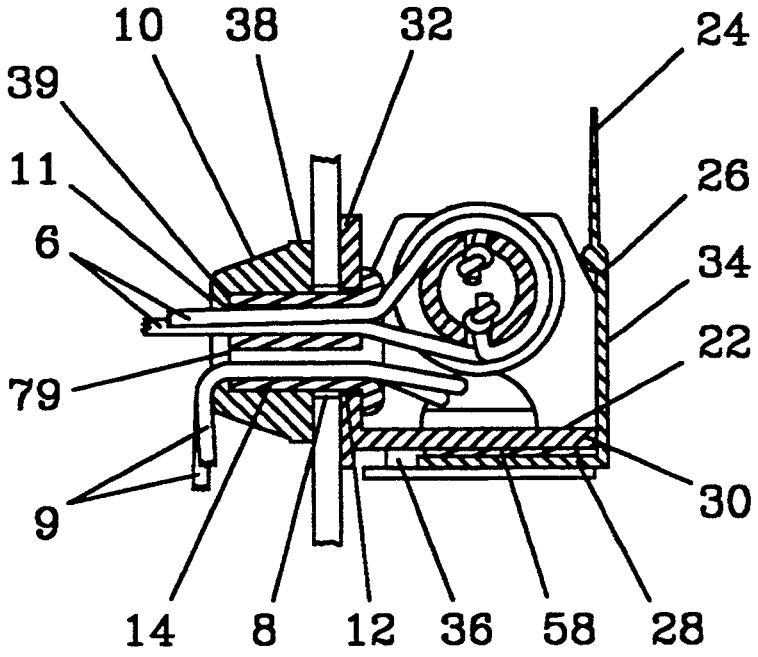
FIG. 4 is a cross-sectional end view of the headrail taken along the line IV—IV of FIG. 3 wherein the tilt control cord is not shown.

Referring now to FIGS. 1 through 4, the headrail 5 is of an elongated U-shape which has a front side 32, a back side 26, and a bottom 30. The headrail 5 is usually made of aluminum. The width of the headrail is preferably not more than ¾ inches. As manufactured, the headrail 5 has a headrail aperture 12 on the front side 32 positioned to align with the glass aperture 8 as shown in FIG. 4. The headrail aperture 12 could be either on a right side or on a left side of the headrail 5. One or more knockouts 13 may be provided. The back side 26 may have a co-molded flexible leaf 24 to block light at the window frame 4.

Preferably, the headrail 5 is made of two pieces as shown in FIGS. 2 and 4. One is a T-shaped piece 22 and the other is an L-shaped piece 34. The front side 32 and the bottom 30 comprise the T-shaped piece 22 and the back side 26, top 24 and a second bottom 28 comprise the L-shaped piece 34. The T-shaped piece 22 has a longitudinal slot 36. Slot 36 receives the second bottom 28 of the L-shaped piece 34. Thus, the two pieces are connected.

The headrail 5 is secured to the pane of glass 2 by the hollow screw 14 and the screw duct 10 which is threaded onto the screw 14. The hollow screw 14 passes through the headrail aperture 12 and the glass aperture 8 and is threaded into the screw duct 10 as shown in FIG. 4.

Preferably, the outside surface 38 of the screw duct 10 has a major diameter of about 0.548 inches, a minor diameter of 0.381 inches and a length of about 0.281 inches. The threaded inside hole of the screw duct 10 preferably has a major diameter of about 0.300 inches and a minor diameter of about 0.279 inches. A seat 39 is provided within the threaded inside hole of the screw duct 10 near a screw duct end 11 to receive a screw body end 79. The seat 39 preferably has a seat diameter of 0.266 inches, and the screw duct end 11 is rounded having a minimum radius of 0.050 inches.

Figure 5:
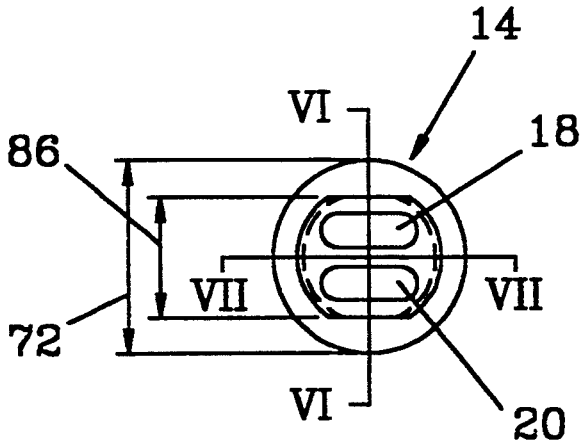
FIG. 5 is a bottom view of a present preferred screw.
Figure 6:
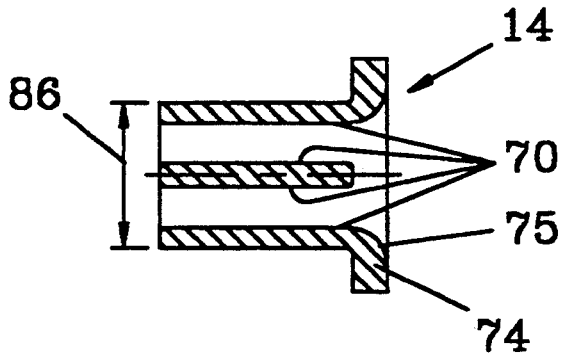
FIG. 6 is a cross-sectional view of the screw taken along line VI—VI of FIG. 5.
Figure 7:
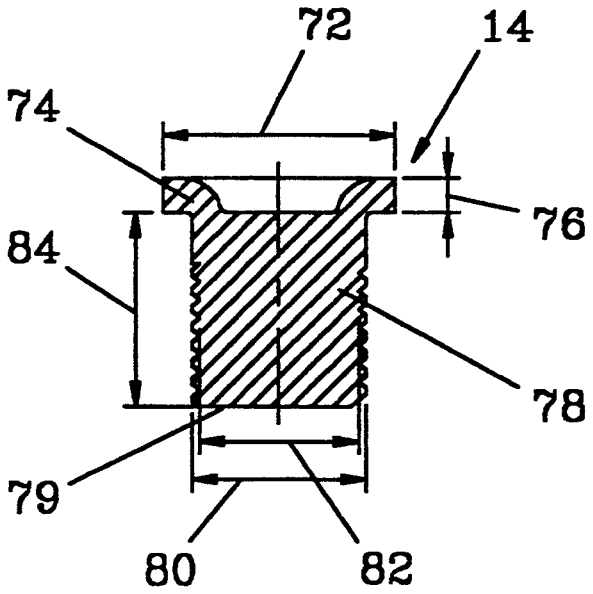
FIG. 7 is a cross-sectional view of the screw taken along line VII—VII of FIG. 5.

Referring now to FIGS. 5 through 7, a head 74 of the hollow screw 14 preferably has a head diameter 74 of 0.438 inches and a head height 76 of 0.070 inches. A screw body 78 preferably has a length 84 of 0.334 inches and is partially threaded. This length in combination with screw duct 10 enables the window blind to be attached to a variety of windows having glass of different thickness. Threaded portions of the screw body 78 have a major diameter 80 of 0.297 inches and a minor diameter 82 of 0.2742 inches. Unthreaded portions have a diameter 86 of 0.250 inches which is less than those of the threaded portions.

The hollow screw 14 has an upper screw channel 18 and a lower screw channel 20. The lift cord 9 passes through the lower screw channel 20, and two ends 60, 62 of the tilt control cord 6 pass through the upper screw channel 18 side by side. The two separate channels prevent the cords from intertwining each other. Thus, the cords do not rub each other.

Inside surfaces 70 of the screw channels are free of flash or sharp edges. All edges of the screw 14 are rounded having a minimum radius of 0.010 inches screw head radius 75 has a minimum radius of 0.100 inches as shown in FIG. 6. Preferably, each screw channel is of an oval shape as shown in FIG. 7 and about 0.070 inches wide and about 0.200 inches long. The cords are not cut or worn out by the edges of the screw 14 or the screw duct 10. Therefore, life of both cords is extended.

An alternative is to provide a screw duct 10 having a web 16 sized and positioned to align to the lift cord 9 and the ends 60, 62 of the tilt control cord 6. The web 16 also prevents the cords from running over one another.

Tilting means are shown in FIGS. 1 through 3. They are comprised of a tiltrod 40, a tilt spool 50, at least one support 44, at least one tilt cord 7 and a tilt control cord 6. The tiltrod 40 is an elongated rod and positioned parallel to the slats 3 within the headrail 5. The tiltrod 40 is preferably of a paragonal shape. The tiltrod 40 is rotatably fixed to the support 44 which are attached to the bottom 30 of the headrail 5 and positioned within the headrail 5.

The tiltrod 40 is preferably further comprised of a hollow tube-shaped tape roll 42. The tape roll 42 is positioned around the tiltrod 40 and rested over the support 44 as shown in FIG. 1. The tiltrod 40 may be comprised of at least two pieces when at least one tape roll 42 tightly connects the pieces together in a line.

The support 44 is preferably of a U-shape, having two support arms 48 and a support bottom 46. The tape roll 42 is placed between or across the support arms 48. The support bottom 46 is connected to the bottom 30 of the headrail 5, preferably with transfer adhesive or any other of fastening means 58.

Figure 8:
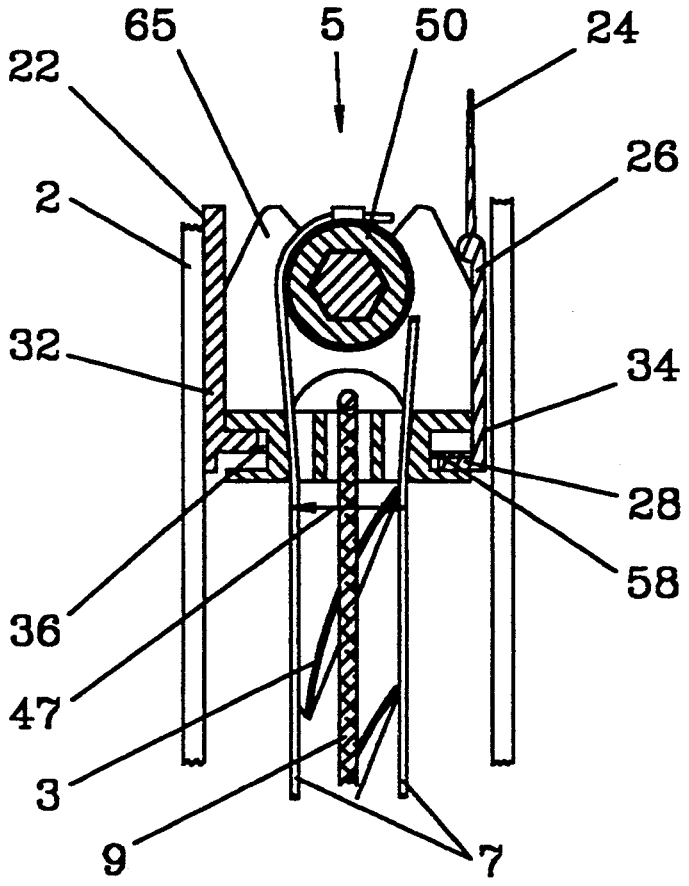
FIG. 8 is a cross-sectional view of the left side of a present preferred tape roll support. Taken along line VIII—VIII of FIG. 1.
Figure 9:
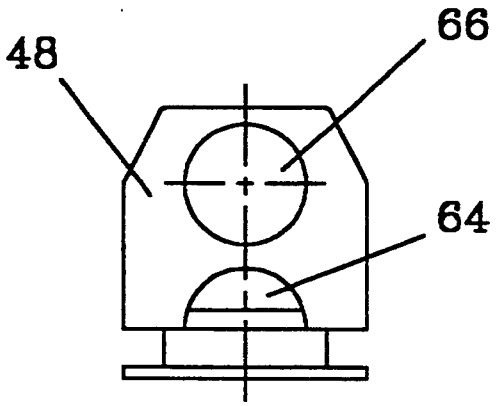
FIG. 9 is an elevational view of the right side of the present preferred tape roll support.
Figure 10:
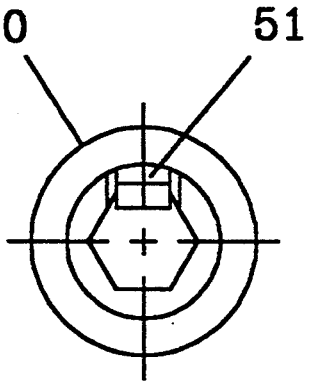
FIG. 10 is an elevational view of the left side of a present preferred tilt spool.
Figure 11:
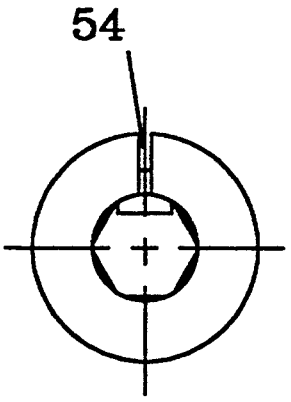
FIG. 11 is an elevational view of the right side of the present preferred tilt spool.
Figure 12:
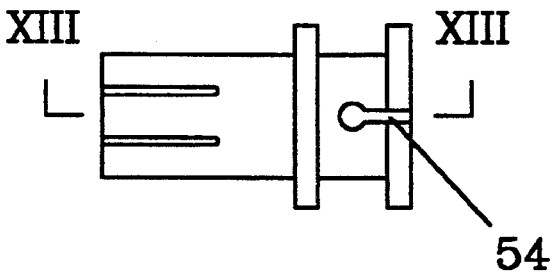
FIG. 12 is an elevational top view of the present preferred tilt spool.
Figure 13:
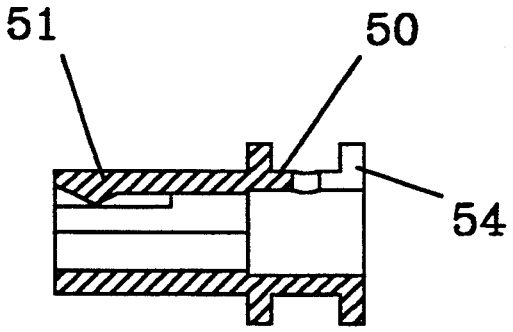
FIG. 13 is a cross-sectional front view of the present preferred tilt spool taken along line XIII—XIII of FIG. 12.

One of the support arms 48 preferably has a closed hole 66 and the other has a U-shaped member 65 as shown in FIGS. 8 and 9. After the tiltrod is fit through the closed hole 66, the tape roll 42 is pushed down and fit into the U-shaped member 65. At least one of the support arms 48 preferably has a semi-circle arm hole 64 at bottom, through which the lift cord 9 passes. Then, the lift cord 9 passes through the support 44 and is connected to the slats 3.

A tilt cord 7 may also pass through the support 44 and be connected to the slats 3 when the tilt cord 7 is rolled around the tape roll 42. In this case, the tape roll 42 preferably fits tightly around the tiltrod 40. Thus, when the tiltrod 40 is rotated, the tape roll 42 is also rotated as shown in FIG. 8.

Preferably the spacing between the route holes 46 indicated by arrow 47 in FIG. 8 is less than the diameter of the tilt spool 50 to assure a tighter close of the slats 3.

I prefer to provide spacing of 0.304 inches for a tilt spool diameter of 0.375 inches.

As shown in FIG. 3, the tilt spool 50 is attached to the tiltrod 40 and positioned right behind the screw 14, adjacent the headrail aperture 12, and within the headrail 5. A first end 60 of the tilt control cord 6 is attached to and wound clockwise around the tilt spool 50 and a second end 62 is wound counterclockwise around the tilt spool 50. Then, both ends 60, 62 pass through the upper screw channel 18 side by side.

FIGS. 10 through 13 show a preferred present type of the tilt spool having a tilt spool hole 54, through which the tilt control cord 6 passes and both ends 60, 62 are wound around the tilt spool 50 in opposite directions as shown in FIGS. 3 and 4. One end of the tiltrod 40 preferably fits into one side of the tilt spool 50, and the side has locking tab 51 to facilitate holding the end of the tiltrod. The tilt spool 50 can be fit optionally to either end of the tiltrod 40 to offer right or left side control.

Although I have described and shown certain present preferred embodiments of my invention, it should be understood that the invention is not limited thereto but may be variously embodied within the scope of the following claims.

I claim:

1. A window blind for use between two panes of glass seated in a window frame, one pane of glass having a glass aperture, the window blind comprising:

a. an elongated U-shaped headrail sized to be positioned between the two panes of glass, the headrail having a front side, a back side, a bottom, and a headrail aperture on the front side positioned to align with the glass aperture;

b. a plurality of spaced parallel slats;

c. at least one lift cord extending from the headrail through the slats to a bottom rail;

d. a hollow screw passing through the headrail aperture from inside the headrail to outside the headrail, the hollow screw having a first screw channel and a second screw channel through which second screw channel at least one lift cord passes;

e. a screw duct threaded onto the hollow screw, the screw duct having a threaded inside hole; and f. means for tilting the slats about parallel axes, the means comprising i) an elongated tiltrod positioned parallel to the slats within the headrail, ii) a tilt spool attached to the tiltrod and positioned right behind the hollow screw, adjacent the headrail aperture and within the headrail, iii) at least one tilt cord which extends from the tiltrod being secured to and supporting the slats, iv) a tilt control cord having a first end attached to and wound clockwise around the tilt spool and a second end wound counterclockwise around the tilt spool, the ends passing through the headrail aperture and the first screw channel side by side, and iv) at least one support on which the tiltrod is rotatably placed, the support being attached on the bottom of the headrail and positioned within the headrail.

2. The window blind of claim 1 wherein the headrail aperture is provided with one or more knockouts.

3. The window blind of claim 1 further comprising a flexible leaf attached to the backside of the headrail to block light at the window frame.

4. The window blind of claim 1 wherein the headrail is comprised of two pieces.

5. The window blind of claim 1 wherein the headrail has an elongated L-shaped piece and an elongated T-shaped piece, the T-shaped piece being comprised of the front side and the bottom, and the L-shaped piece being comprised of the backside and a second bottom, the front side of the T-shaped piece having a longitudinal slot extending under the bottom along said headrail to receive the support and the second bottom of the L-shaped piece.

6. The window blind of claim 1 wherein the hollow screw has a threaded outside surface.

7. The window blind of claim 1 wherein the screw duct has a seat within the threaded inside hole to receive the hollow screw.

8. The window blind of claim 1 wherein all edges of the hollow screw and the screw duct are rounded.

9. The window blind of claim 1 wherein the tilt spool has a tilt spool hole through which the tilt control cord passes.

10. The window blind of claim 1 wherein the tiltrod is further comprised of at least one hollow tube-shaped tape roll and at least one solid rod, the tape roll being attached to the solid rod and rotatably positioned on the support.

11. The window blind of claim 10 wherein the tiltrod is comprised of at least two pieces and at least one tape roll tightly connects the pieces together in a line.

12. The window blind of claim 10 wherein the support has a support bottom and a first and a second support arms across which arms the tape roll is placed, and the support bottom is attached to the bottom of the headrail.

13. The window blind of claim 12 wherein the first support arm has a closed hole and the second support arm has a U-shaped member to receive the tiltrod.

14. The window blind of claim 12 wherein at least one of the first and the second support arms have an arm hole through which the lift cord passes.

15. The window blind of claim 12 wherein the support bottom is connected to the bottom of the headrail through which the lift cord passes.

16. The window blind of claim 15 wherein the tape roll tightly fits around the tiltrod and the tilt cord is rolled around the tape roll and passes through the support bottom.

17. The window blind of claim 1 wherein a distance between the front side and back side of the headrail is not more than $\frac{3}{4}$ inches.

18. A window blind for use between two panes of glass seated in a window frame, one pane of glass having a glass aperture, the window blind comprising:

a. an elongated U-shaped headrail sized to be positioned between the two panes of glass, the headrail having a front side, a back side, a bottom, and a headrail aperture on the front side positioned to align with the glass aperture;

b. a plurality of spaced parallel slats;

c. at least one lift cord extending from the headrail through the slats to a bottom rail;

d. means for tilting the slats about parallel axes, the means comprising i) an elongated tiltrod positioned parallel to the slats within the headrail, ii) a tilt spool attached to the tiltrod and positioned right behind the hollow screw, adjacent the headrail aperture and within the headrail, iii) at least one tilt cord which extends from the tiltrod being secured to and supporting the slats, iv) a tilt control cord having a first end attached to and wound clockwise around the tilt spool and a second end wound counterclockwise around the tilt spool, and v) at least one support on which the tiltrod is rotatably placed, the support being attached to the bottom of the headrail and positioned within the headrail;

e. a hollow screw passing through the headrail aperture from inside the headrail to outside the headrail, the hollow screw having a longitudinal screw channel through which the lift cord and the first and the second end of the tilt control cord pass; and f. a screw duct threaded onto the hollow screw, the screw duct having a threaded inside hole and a web within the threaded inside hole, the web being sized and positioned to align separately to the lift cord and the first and second ends of the tilt control cord which pass through the screw channel.

* * * * *

UNITED STATES PATENT AND TRADEMARK OFFICE

CERTIFICATE OF CORRECTION

PATENT NO. : 5,379,825

DATED : January 10, 1995

INVENTOR(S) : Ralph Jelic

It is certified that error appears in the above-indentified patent and that said Letters Patent is hereby corrected as shown below:

Column 6, line 3, claim 5, change "1" to --4--.

Signed and Sealed this

Twenty-third Day of May, 1995

*Attest:*

Bruce Lehman

BRUCE LEHMAN

*Attesting Officer*

*Commissioner of Patents and Trademarks*